US007942720B1

(12) United States Patent
Galoustian

(10) Patent No.: US 7,942,720 B1
(45) Date of Patent: May 17, 2011

(54) ANIMATED "PEEK-A-BOO" STUFFED TOY CREATURE

(76) Inventor: Rima Galoustian, Glendale, CA (US)

( * ) Notice: Subject to any disclaimer, the term of this patent is extended or adjusted under 35 U.S.C. 154(b) by 221 days.

(21) Appl. No.: 11/807,382

(22) Filed: May 29, 2007

(51) Int. Cl.
*A63H 3/20* (2006.01)
*A63H 3/28* (2006.01)

(52) U.S. Cl. ..... 446/298; 446/301; 446/297

(58) Field of Classification Search ..... 446/298, 446/301, 297
See application file for complete search history.

(56) References Cited

U.S. PATENT DOCUMENTS 3,153,881 A * 10/1964 Baulard-Cogan ..... 446/180
3,665,643 A * 5/1972 Colgrove ..... 446/457
3,672,096 A * 6/1972 Johmann ..... 446/338
3,851,418 A 12/1974 Barlow et al.
4,164,827 A 8/1979 Pallumbo
5,501,627 A 3/1996 Ekstein
5,700,178 A * 12/1997 Cimerman et al. ..... 446/301
2006/0150451 A1 * 7/2006 Spielberger et al. ..... 40/412
* cited by examiner

*Primary Examiner* — Alvin A Hunter
*Assistant Examiner* — Michael D Dennis
(74) *Attorney, Agent, or Firm* — John R. Ross; John R. Ross, III

(57) ABSTRACT

A child's stuffed teddy bear embodiment is made with arms that are animated by an internal electronically-controlled electric motor. The paws at the ends of arms are normally located initially so as to cover the bear's eyes, with the head inclined slightly and the eyes downcast. When a child approaches the bear within a predetermined distance, a built-in proximity sensor initiates the bear's built-in animation system to move the arms so as to remove the hands from the eyes, incline the head upwardly and immediately speak a phrase such as "peek-a-boo" generated by a built-in speech synthesizer, audio amplifier and loudspeaker. Then the cycle is completed by returning to the initial condition: the end of the paws again covering the eyes and the head inclining downwardly.

14 Claims, 2 Drawing Sheets

ANIMATED "PEEK-A-BOO" STUFFED TOY CREATURE

FIELD OF THE INVENTION

The present invention is in the field of animated stuffed toys and more particularly a child's stuffed toy representing a living creature and having the ability to perform designated arm movements and to emit the sound of a voice speaking a simple phase whenever approached by the child.

BACKGROUND OF THE INVENTION

Modern technology has opened up many new possibilities of enriching the interactive experience between a child and an animated stuffed toy.

Audio technology has enabled voice synthesis and even voice recognition to become available at low cost.

Animation technology has resulted in the development of small battery-operated motors and sophisticated mechanical linkage that now enable robot-like performance in popular-priced toys.

DESCRIPTION OF KNOWN ART

U.S. Pat. No. 5,700,178 by Cimerman et al for EMOTIONAL EXPRESSION CHARACTER is an example of planar or essentially two-dimensional animation of the arms of a teddy bear that are each made to rotate about a pivot point in a manner to cover and uncover the eyes and face and to provide visual and audible expression displays that are coordinated to provide representation for a specific emotional state (e.g. sad, happy, sleepy, etc. U.S. Pat. No. 5,501,627 by Ekstein for a CHILDREN'S TOY WITH PEEK-A-BOO ACTIVATION is an example of a more fully three dimensional stuffed doll figure that includes photodetectors as sensors located in the area of the doll's eyes and movable arms configured such that the hands of the doll may be placed over its eyes and then promptly removed, whereupon a speech synthesizer produces a message such as "peek-a-boo".

OBJECTS OF THE INVENTION

It is a main object of the invention to provide, as a child's toy, a stuffed creature with a predetermined degree of animation and audible synthesized speech that are made to become activated upon sufficient closeness of approach of the child.

It is a further object to provide a default condition of the animated stuffed creature where its eyes are covered by its hands, one on each, and to enable am animated condition wherein the stuffed creature removes its hands from its eyes, raises its head and speaks "peek-a-boo" in a synthesized voice

SUMMARY OF THE INVENTION

The abovementioned objects have been met in the present invention of a child's stuffed teddy bear, made with arms and head that are animated by an internal electric motor and gear train. The ends of arms are normally located so as to cover the bear's eyes, with the head inclined slightly and the eyes downcast. When the child approaches the bear within a predetermined distance, a built-in proximity sensor initiates the bear's built-in animation system to move the arms so as to remove the hands from the eyes, incline the head upwardly and immediately speak a phrase such as "peek-a-boo" from a built-in speech synthesizer, audio amplifier and loudspeaker.

Then the cycle is completed by returning to the default condition: the end of the arms again covering the eyes and the head inclining downwardly.

BRIEF DESCRIPTION OF THE DRAWINGS

The above and further objects, features, and advantages of the present invention will be more fully understood from the following description taken with the accompanying drawings in which.

DETAILED DESCRIPTION

Figure 1:
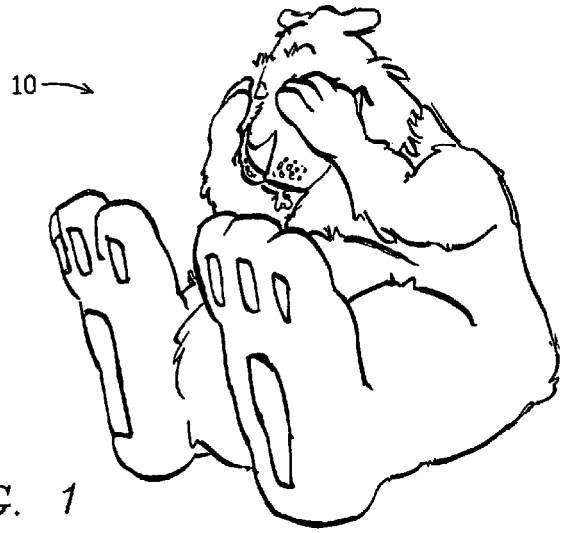
FIG. 1 is a perspective view of a preferred embodiment of the present invention shown as a fully assembled stuffed teddy bear shown in the default mode.
Figure 2:
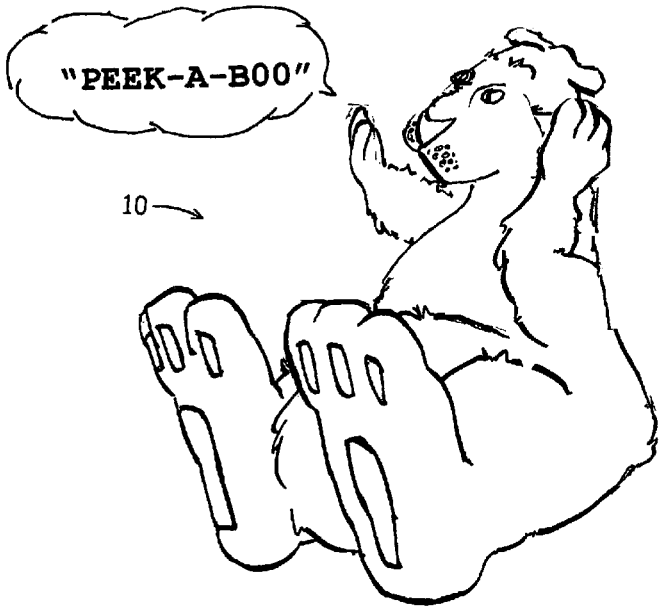
FIG. 2 is a perspective view of the teddy bear of FIG. 1, shown in the animated mode.

FIG. 1 is a perspective view of a preferred embodiment of the present invention shown as a fully assembled stuffed teddy bear 10 shown in the default mode FIG. 2 is a perspective view of the teddy bear 10 of FIG. 1, shown in the animated mode with an audible spoken phrase indicated.

Figure 3:
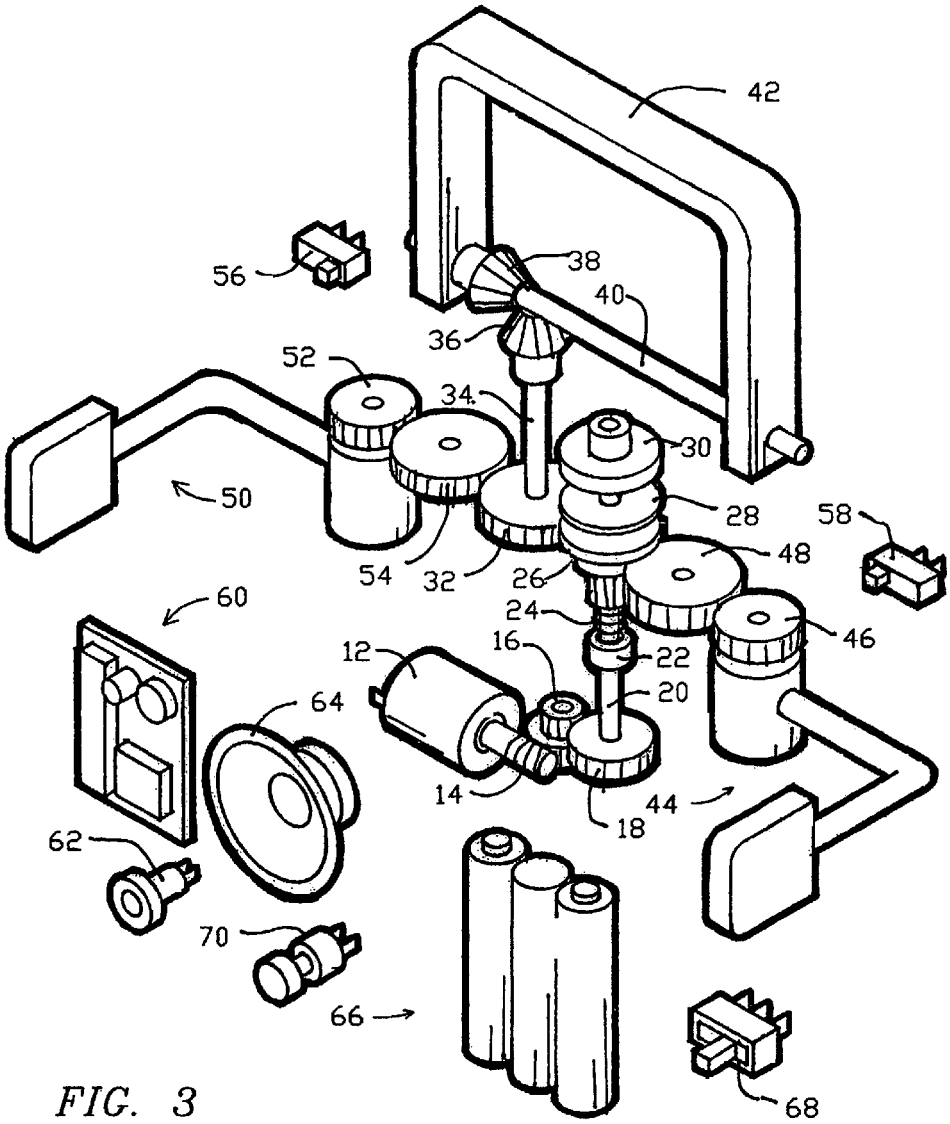
FIG. 3 is an exploded three-dimensional view of the mechanized framework of the animated teddy bear of FIGS. 1 and 2, showing the component parts.

FIG. 3 is an exploded three-dimensional view of the mechanized framework of the animated teddy bear 10 of FIGS. 1 and 2, showing the component parts in their approximate relative location.

Motive power for animation is provided by a 4.5 volt electric motor 12 with a worm on shaft 14 driving worm gear 16 of which a pinion portion drives spur gear 18 on shaft 20 of a main driveshaft assembly. A collar 22 on drive shaft 20 supports a coil spring 24 and a combined spur gear and pressure plate 26 which is free-running on drive shaft 20 and which is driven from the bottom side of a friction disk 28 whose top side is driven by pressure plate 30 which is attached to the upper end of driveshaft 20.

The spur gear portion of combined spur gear and pressure plate 26 drives a swivel-neck head positioning assembly of the teddy bear via a drive train including spur gear 32, head driveshaft 34, bevel gear 36 engaging bevel gear 38 attached to neck-swivel axle 40 along with main head bracket 42.

A left arm assembly 44 is actuated by attached spur gear 46, driven via intermediate spur gear 48 from combined spur gear and pressure plate 26 via spur gear 46. Similarly a right arm assembly 50 is actuated by attached spur gear 52, driven via intermediate spur gear 54 from spur gear 32 which introduces the necessary direction reversal between the two arms to cause them to open and close. Limit switches 56 and 58 reverse the direction of motor 12 when the arm assemblies 44 and 50 have opened out or closed to a desired limit position and thus cause the animation to reverse in direction.

An electronic circuit board 60 senses proximity of a person via a phototransistor light sensor 62 to control initiation of animation. Circuit board 60 also generates a synthesized voice signal that is amplifier and applied to loudspeaker 64. Circuit board 60 and motor 12 are powered from battery pack 66, consisting of three AA dry cells. A main on-off switch 68 is preferably implemented as a three position SPDT slide switch wherein the central position is totally "off" with no battery drain, and two "on" positions with different timing protocols. An optional toe switch 70, typically an instantaneous pushbutton, can be provided to initiate animation by moving or pushing a toe of the teddy bear.

There are a number of optional timing mode protocols that can be implemented in the programming of circuit board 60. Normally, when switched "on", the unit remains in a standby mode ready to initiate animation in response to user-proximity. Once initiated, animation may be made to automatically continue through a full cycle, i.e. arms open and close, and then stop in the default position, i.e. eyes covered, regardless of user-proximity, requiring the user to move away out of range of sensor 62 and re-approach to repeat the cycle. Alternatively the cycle could be made to repeat continuously as long as the user remains within the range of sensor 62. Since there is ongoing battery current drain in the standby mode, there would be risk of totally depleting a battery by unintentional failure to switch the unit off after a play session. Therefore it is desirable to protect battery life by providing in the protocol a timer that, in normal use by a child, will automatically turn the unit totally off and end the standby mode after a predetermined inactive time period. However for store demonstration purposes, it is desirable to provide an alternative protocol that disables automatic shutoff.

As an alternative to implementation as a teddy bear as shown in the illustrative embodiment, the invention may be practiced in the form of any other living creature, e.g. animals such as a monkey, rabbit, dog, fox, cat, lion etc., or as a human doll figure.

As an alternative to the condition shown in the illustrative embodiment as the default, i.e. with the hands covering the eyes, the invention may be practiced with other hand locations and motions: e.g. initially covering the mouth, nose or ears, etc.

The extent of automation could be changed from that shown in the preferred embodiment: for instance the head movements could be augmented to include rotation and/or side-to-side tilting. Automation could be applied to hand movements, or other body parts such as legs or ears.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. An animated stuffed toy, comprising:

a main body, made and arranged to simulate a designated living creature in three dimensions, including, as movable parts, a left arm and a right arm, and a movable head with a face region including a pair of eyes, the movable parts being disposed in a default inter-relationship wherein the head is tilted forward and downward in a nodding position, and wherein said left arm and said right arm are operative to cover said pair of eyes;

a motor connected to said movable head, said left arm and said right arm;

a power source connected to said motor;

a drive shaft connected to said motor, said drive shaft comprising a threaded drive shaft worm;

a drive shaft worm gear meshed with said threaded drive shaft worm, said drive shaft worm gear comprising a pinion;

a spur gear meshed with said pinion, said spur gear comprising a spur gear shaft;

a collar connected to said spur gear shaft, said collar supporting:

a coil spring, and a combined spur gear pressure plate assembly, wherein said combined spur gear pressure plate assembly is free running on said spur gear shaft, an upper pressure plate connected to said spur gear shaft, a friction disk sandwiched between said upper pressure plate, said friction disk for driving said combined spur gear pressure plate assembly, said friction disk driven by said upper pressure plate, a swivel-neck head positioning assembly, comprising:

a swivel-neck spur gear, a swivel-neck drive shaft connected to said swivel-neck spur gear, a swivel-neck bevel gear connected to said swivel-neck drive shaft, a second swivel-neck bevel gear engaging said swivel-neck bevel gear, a swivel-neck axle connected to said second swivel-neck bevel gear, and, a swivel-neck bracket attached to said swivel-neck axle, wherein said swivel-neck had positioning assembly is driven by said combined spur gear pressure plate assembly engaged with said swivel-neck spur gear, a first left arm spur gear meshed with either said combined spur gear pressure plate assembly or said swivel-neck spur gear, a second left arm spur gear meshed with said first left arm spur gear said second left arm spur gear connected to said movable left arm, a first right arm spur gear meshed with the other of either said combined spur gear pressure plate assembly or said swivel-neck spur gear, and a second right arm spur gear meshed with said first right arm spur gear said second right arm spur gear connected to said movable right arm, an electronic circuit module, contained within said main body, made and arranged to provide control of said electric driving means and to generate an audio signal replicating a interactive message as spoken by a human voice;

a loudspeaker, contained within said main body, receiving the audio signal, made and arranged to emit said interactive message;

a proximity sensor, contained within said main body, made and arranged to detect presence of a human body within a predetermined proximity, and to consequently provide an input signal to said electronic circuit module indicating such presence, said electronic circuit being made and arranged to respond to such input signal by activating said electric driving means to actuate movable parts of said main body in a manner to (a) move said left arm and said right arm forward while moving the head rearward to an upright position, so as to fully expose the eyes, (b) then generate said interactive message, and (c) then return the movable parts to the default inter-relationship; and a battery pack contained within said main body, made and arranged to provide electrical power required by said electric driving means and said electronic module.

2. The animated stuffed toy as defined in claim 1 wherein said electric driving means comprises an electric motor and a plurality of associated gear trains.

3. The animated stuffed toy as defined in claim 2 wherein the associated gear trains include, in a direct gear train driven from said electric motor, a worm type reduction gear and a slippage mechanism including a friction disk interposed between a pair of pressure plates, made and arranged to accommodate overriding movement of the selected body parts by a user.

4. The animated stuffed toy as defined in claim 1 wherein said main body is made as a teddy bear and is further configured with a pair of legs made and arranged to enable said main body and the legs to be formed into a sitting position.

5. The animated stuffed toy as defined in claim 1 wherein said interactive message is "Peek-a-boo".

6. The animated stuffed toy as defined in claim 2 wherein:

in the default inter-relationship, the movable part are made and arranges such that the head is tilted forward and downward and an end of each of the two arms covers corresponding first and second portions of the face region including both of the pair of eyes; and in response to the input signal, said electric driving means is made to actuate the movable parts in a manner to (a) move the arms in generally arcuate forward and outward paths that are mirror-symmetrical, while moving the head rearward to an upright position, so as to fully expose the eyes, (b) then generate the audio signal, and (c) then return the movable parts to the default inter-relationship.

7. The animated stuffed toy as defined in claim 6 comprising:

a left arm assembly, actuated from said electric drive means via an attached left arm spur gear, of the direct gear train, that is made and arranged to rotate about a vertical axis located in a left hand region of said main body, said left arm assembly being located offset radially from the vertical axis so as to travel in a generally horizontal arcuate path; and a right arm assembly, actuated from said electric drive means via an attached right arm spur gear of the direct gear train, made and arranged to rotate about a vertical axis located in a right hand region of said main body, said right arm assembly being located offset radially from the vertical axis so as to travel in a generally horizontal arcuate path that is substantially in mirror-image symmetry with the arcuate path of said left arm assembly, so as to cause the arms to cover and respective eyes in the default inter-relationship and to move in the arcuated paths so as to uncover the eyes when said electric driving means is actuated.

8. An animated stuffed toy, comprising:

A. a movable head comprising a pair of eyes,

B. a movable left arm comprising a left hand,

C. a movable right arm comprising a right hand,

D. a speaker for emitting an audio sound of an interactive message to a child,

E. a proximity switch for detecting the presence of a child,

F. a controlling means connected to said proximity switch and said speaker,

G. a motor connected to said controlling means and said movable head, said movable left arm and said movable right arm, wherein said motor is controlled by said controlling means and wherein said motor moves said movable head, said movable left arm and said movable right arm in response to signals from said controlling means, H. a power source connected to said controlling means and said motor, wherein said proximity switch sends a signal to said controlling means when a child approaches said stuffed toy causing said controlling means to send a control signal to said motor and a signal to said speaker to cause said stuffed toy to move said movable head, movable left arm and movable right arm and to emit said audio sound of an interactive message to the child, I. a drive shaft connected to said motor, said drive shaft comprising a threaded drive shaft worm, J. a drive shaft worm gear meshed with said threaded drive shaft worm, said drive shaft worm gear comprising a pinion, K. a spur gear meshed with said pinion, said spur gear comprising a spur gear shaft, L. a collar connected to said spur gear shaft, said collar supporting:

1. a coil spring, and
2. a combined spur gear pressure plate assembly, wherein said combined spur gear pressure plate assembly is free running on said spur gear shaft, M. an upper pressure plate connected to said spur gear shaft, N. a friction disk sandwiched between said upper pressure plate, said friction disk for driving said combined spur gear pressure plate assembly, said friction disk driven by said upper pressure plate, O. a swivel-neck head positioning assembly, comprising:

1. a swivel-neck spur gear,
2. a swivel-neck drive shaft connected to said swivel-neck spur gear,
3. a swivel-neck bevel gear connected to said swivel-neck drive shaft,
4. a second swivel-neck bevel gear engaging said swivel-neck bevel gear,
5. a swivel-neck axle connected to said second swivel-neck bevel gear, and,
6. a swivel-neck bracket attached to said swivel-neck axle, wherein said swivel-neck had positioning assembly is driven by said combined spur gear pressure plate assembly engaged with said swivel-neck spur gear, P. a first left arm spur gear meshed with either said combined spur gear pressure plate assembly or said swivel-neck spur gear, Q. a second left arm spur gear meshed with said first left arm spur gear said second left arm spur gear connected to said movable left arm, R. a first right arm spur gear meshed with the other of either said combined spur gear pressure plate assembly or said swivel-neck spur gear, and S. a second right arm spur gear meshed with said first right arm spur gear said second right arm spur gear connected to said movable right arm.

9. The animated stuffed toy as in claim 8, wherein said movable head moves forward and rearward.

10. The animated stuffed toy as in claim 8, wherein said movable left arm and said movable right arm move so that said left hand and said right hand cover and then uncover said pair of eyes.

11. The animated stuffed toy as in claim 8, wherein said inviting message is "Peek-a-boo".

12. The animated stuffed toy as in claim 8, wherein said controlling means is a printed circuit board.

13. The animated stuffed toy as in claim 12, wherein said proximity switch is mounted onto said printed circuit board.

14. The animated stuffed toy as in claim 8, wherein said motor is connected to said movable head, said movable right arm and said movable left arm through a series of gears and linkages.

* * * * *